US005370883A

United States Patent [19]

Saunier

[11] Patent Number: 5,370,883

[45] Date of Patent: Dec. 6, 1994

[54] PACKAGE HAVING ALUMINUM LAMINATE SIDE WALL SHIELD

[75] Inventor: Christiane-Monique Saunier, Bjuv, Sweden

[73] Assignee: Nestec S.A., Vevey, Switzerland

[21] Appl. No.: 866,794

[22] Filed: Apr. 8, 1992

[30] Foreign Application Priority Data

Apr. 30, 1991 [EP] European Pat. Off. ..... 91106984.7

[51] Int. Cl.[5] ..... A23L 1/025; B65D 81/34; B65D 85/72

[52] U.S. Cl. ..... 426/107; 219/729; 219/734; 220/268; 229/3.5 MF; 229/80.5; 229/244; 229/245; 426/113; 426/122

[58] Field of Search ..... 426/107, 113, 122, 127; 219/10.55 E, 729, 734; 220/268, 270, 450; 229/3.5 MF, 80.5, 238, 243, 244, 245; 428/34.2

[56] References Cited

U.S. PATENT DOCUMENTS

| | | | |
|---|---|---|---|
| 3,865,301 | 2/1975 | Pothier et al. | 220/450 |
| 4,081,646 | 3/1978 | Goltsos | 219/10.55 E |
| 4,351,997 | 9/1982 | Mattisson et al. | 219/10.55 E |
| 4,592,914 | 6/1986 | Kuchenbecker | 426/107 |
| 4,626,641 | 12/1986 | Brown | 219/10.55 E |
| 4,661,672 | 4/1987 | Nakanaga | 219/10.55 E |
| 4,703,149 | 10/1987 | Sugisawa et al. | 219/10.55 E |
| 4,866,232 | 9/1989 | Stone | 219/10.55 E |
| 4,916,280 | 4/1990 | Havette | 219/10.55 E |
| 4,992,638 | 2/1991 | Hewitt et al. | 219/10.55 E |

FOREIGN PATENT DOCUMENTS

| | | |
|---|---|---|
| 1593523 | 7/1981 | United Kingdom . |
| 2112257A | 7/1983 | United Kingdom . |

*Primary Examiner*—Leo B. Tentoni
*Attorney, Agent, or Firm*—Vogt & O'Donnell

[57] ABSTRACT

A package for heating food has a cover for covering a tray and provides an aluminum laminate for covering the tray side wall. The cover is configured to extend over the top opening or over the base of the tray and cover the tray side wall. In one embodiment, only side edge portions of the cover are formed of an aluminum laminate. In another embodiment, the entirety of the cover is formed of an aluminum laminate, in which case, the cover has lines of weakening positioned therein for tearing and removing a central portion of the cover.

14 Claims, 4 Drawing Sheets

FIG. 1
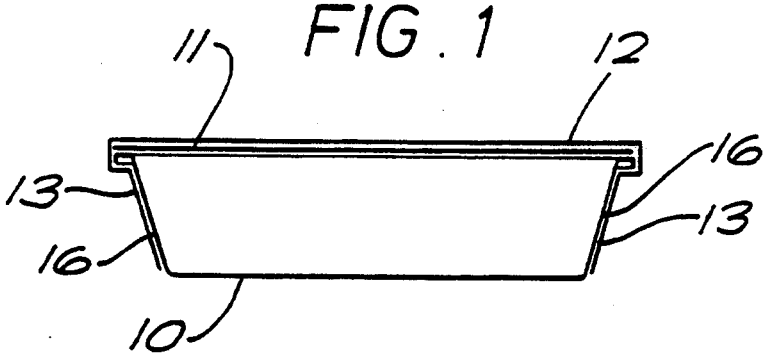
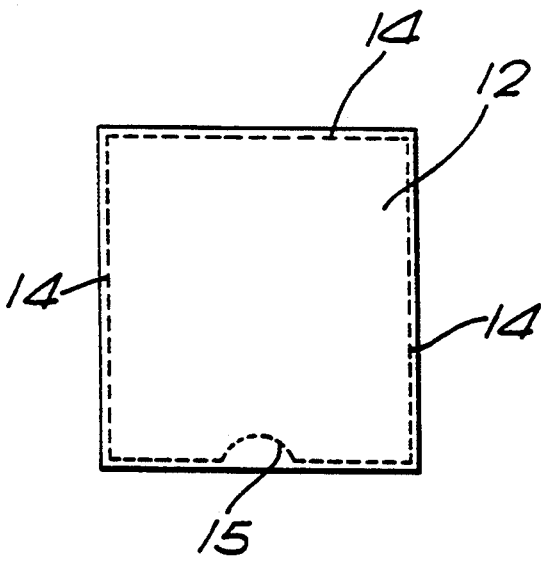
FIG. 2
FIG. 3
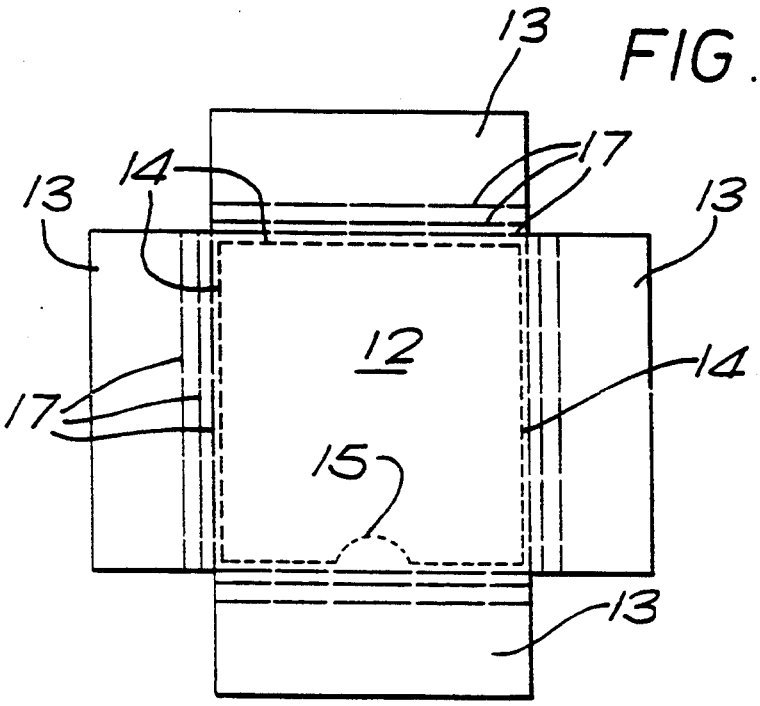

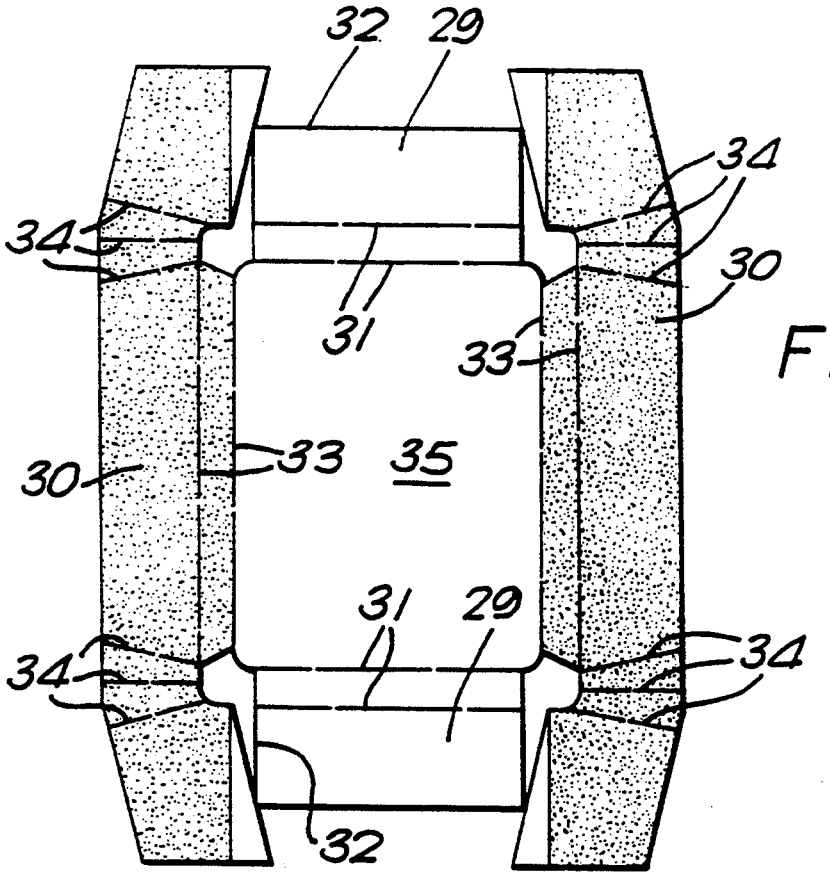
FIG. 7
FIG. 8
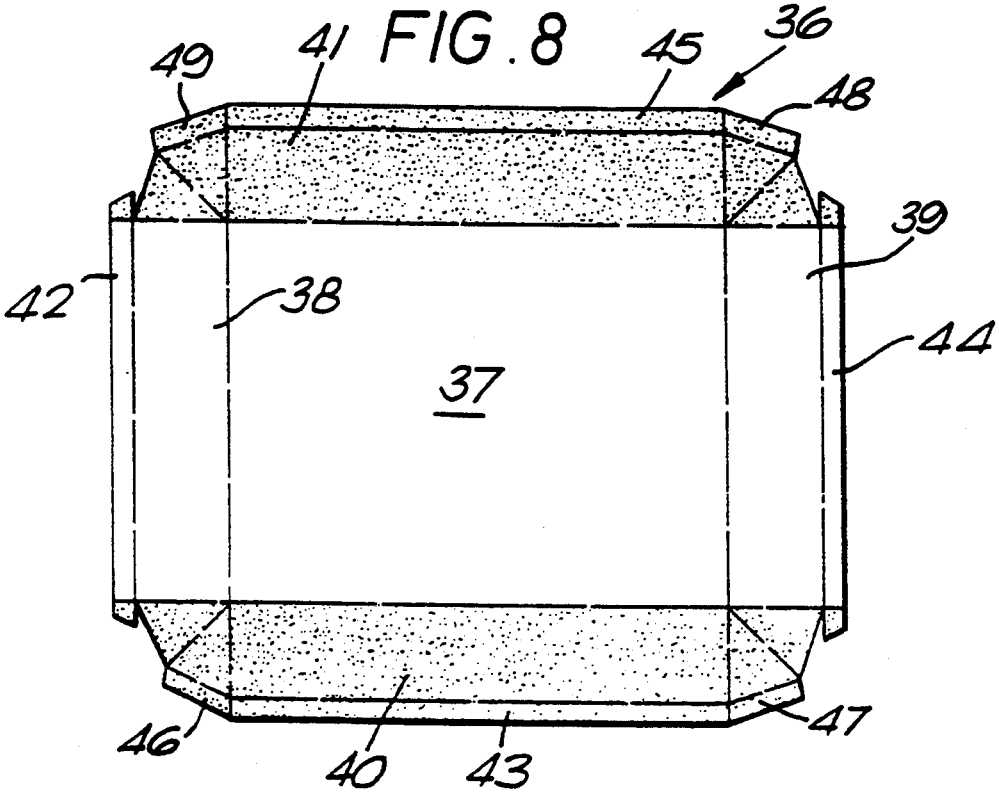

PACKAGE HAVING ALUMINUM LAMINATE SIDE WALL SHIELD

BACKGROUND OF THE INVENTION

This invention relates to a food package for controlled heating or cooking of food in hot air, convection, household and microwave ovens.

The rapid increase of microwave oven sales to private households and the development of catering have changed the conditions for the prepared food manufacturers, implying great advantages as well as problems. The advantages are evident and connected with the rapid heating in microwaves which makes frozen prepared food even more convenient. There are two main problems:

The traditional metallic tray is opaque to microwave radiation and is not suitable in microwave ovens, as arcing may occur inside the oven cavity resulting in a very bad perception of this package by the consumer. Since metals are not transparent to microwaves and heating is obtained only from the top, when compared to heating in a plastic container, cooking is not only longer but also uneven, especially with frozen products in which the bottom layer is still frozen while the top layer is overcooked and unacceptable (dry or burnt).

Plastic trays are transparent to microwave radiation but owing to the limited penetration of microwaves and to the different absorptions of microwaves by the components of the products, e.g., water and ice, the cooking of frozen products is uneven. Hot spots appear in the corners and along the walls of the tray while the center is still frozen.

Development work in the package industry in relation to microwave cooking has dealt with the problem of selective cooking of multi-component meals in which the individual food components generally require different quantities of microwave energy exposure.

For example, U.S. Pat. No. 3,865,301 describes a shielded container for a plurality of ingredients of a sandwich-type food product that are to be heated or cooked to a different extent and which is opaque to microwave radiation except for radiation-transparent windows.

U.S. Pat. No. 4,081,646 illustrates a tray of a material transparent to microwave energy with a plurality of compartments, a cover formed of a material that is transparent to microwave radiation and adapted to the tray and a shielding box having walls opaque to microwave energy and bearing apertures at predetermined locations for inserting the tray with the cover therein, in order to control the amount of radiation received by each of the individual components of a meal.

In the prior developments, very little attention has been paid to uneven cooking of a prepared dish within a single compartment or tray in a microwave oven. In U.S. Pat. No. 4,351,997, there is described a new design for a dual ovenable tray to avoid this uneven cooking in microwave ovens. This design is related to a tray including a bottom wall and a peripheral wall ending with a horizontally extending rim. The rim is coated partly or totally with a material reflecting or opaque to microwave radiation, such as an aluminum foil. This provides a package in a tray form which gives an excellent temperature distribution in microwave ovens, and it is possible to use the package in hot air, convection and household ovens at temperatures up to 250° C.

The present invention relates to technical and economical new solutions to achieve such a package.

SUMMARY OF THE INVENTION

The present invention provides a food package formed from high temperature resistant materials wherein the side wall is shielded with an aluminum laminate which reflects microwave radiation.

DESCRIPTION OF PREFERRED EMBODIMENTS

The high temperature resistant package of the present invention includes a tray and is conveniently made of a cardboard or paperboard or of a plastic material with good thermal resistance, e.g., crystalline polyethylene terephthalate (CPET), polyether sulfone, polyether imide, polymethylpentene, or suitable combinations of such materials. The package may be polygonal and may have, for example, from 3 to 10 sides. Preferably, the corners have angles rather than curves. The package may be locked by a conventional plastics cap or a cardboard cap.

The aluminum laminate shield may be a simple laminate with a layer of aluminum foil coated onto the inside or the outside of a layer of plastics or cardboard material, i.e., an aluminum-plastics laminate or an aluminum-cardboard laminate, or it may be a complex laminate having at least one layer of aluminum foil and plastics, cardboard or paperboard. The shield may act as an insulating label so that consumers can handle the tray after heating without burning their fingers.

The aluminum foil may have a thickness of from 4 to 80 $\mu$m and preferably from 5 to 15 $\mu$m.

In a first embodiment of the invention, there is provided a microwave transparent high temperature resistant tray suitable for holding a food product and an aluminum laminate shield providing a tray-top cover having a depending side edge adapted to be secured to the side wall of the tray and provided with lines of weakening capable of being torn by hand to enable removal of the top portion of the cover by the consumer just before heating.

In one alternative of the first embodiment, the tray is advantageously made of a conventional plastics material, such as CPET, and the depending side edge of the cover may advantageously be secured to the side wall of the tray by an adhesive, or by suitable seals. The tray is preferably provided with a peelable CPET film lid or any other system for easy opening. The lid could also be a simple heat-sealable film. In both cases, it is preferably pilfer-proof.

A second embodiment of the present invention is to achieve the shielding with a cardboard or plastics cover with depending side edge portions formed from a partially laminated blank wherein the blank is laminated with an aluminum foil along a major or total part of side edge portions of the blank which provide for, as defined by fold lines, the depending side edge portions about a central portion which is not laminated with an aluminum foil. A suitable design permits a complete shield of the side wall of the tray after folding the blank side edge portions along the fold lines. The advantages of this alternative is that the consumer does not have to remove the top portion of the cover since it is not shielded with aluminum.

In a third embodiment of the present invention, a cover as described in the first or second embodiments above is employed which preferably covers only the base and side wall of a tray. The tray is advantageously provided with a peelable plastics film lid, or a plastic or cardboard lid, and a plastic over-cover. The tray is advantageously made of a conventional plastics material such as CPET. Preferably, the cover is secured to the side wall of the tray by means of an adhesive or suitable seals by using glue, or by sealing or by mechanical locking, the latter of which enables easy removal of the shield should it be desired to recycle the tray. In the embodiment wherein the shield cover is provided with lines of weakening capable of being torn by hand, removal of the shield portion adjacent the tray base by the consumer just before heating is enabled.

This alternative is advantageous because it enables:

a) the use of a standard cardboard/aluminum laminate, and b) the use of existing machinery to deposit the shield onto the tray. Such machinery is currently used to produce packages for margarine and butter.

In a fourth embodiment of the invention, there is provided a high temperature resistant cardboard or paperboard tray formed from a blank having a major portion of side edge portions laminated with an aluminum foil for forming a tray having an aluminum laminated sidewall.

The tray may be made of a conventional high temperature resistant cardboard or paperboard and is usually laminated with a plastics material such as polyester or other temperature resistant polymers. The plastics material may also be applied by extrusion coating.

The aluminum foil may be positioned on the outside of the tray, but it is preferably positioned on the inside. The tray may be formed from a blank having corner flaps which are folded to form the walls and glued.

The food packages of the present invention are very cheap and convenient because they may be formed by a simple adaptation of conventional containers commercially available at the present time. The different designs allow a shield very close to the product and this is very important.

The present invention is illustrated further by way of example with reference to the accompanying drawings.

BRIEF DESCRIPTION OF THE DRAWINGS

FIG. 1 is a cross-sectional view of a package according to the first embodiment of the invention.

FIG. 2 is a top plan view of the package of FIG. 1.

FIG. 3 is a plan view of a blank of the shield cover of the package of FIG. 1.

FIG. 7 is a plan view of a partially laminated cover blank according to the invention.

FIG. 8 is a plan view of a blank for forming a tray according to the fourth embodiment of the invention.

DETAILED DESCRIPTION OF THE DRAWINGS

Figure 4:
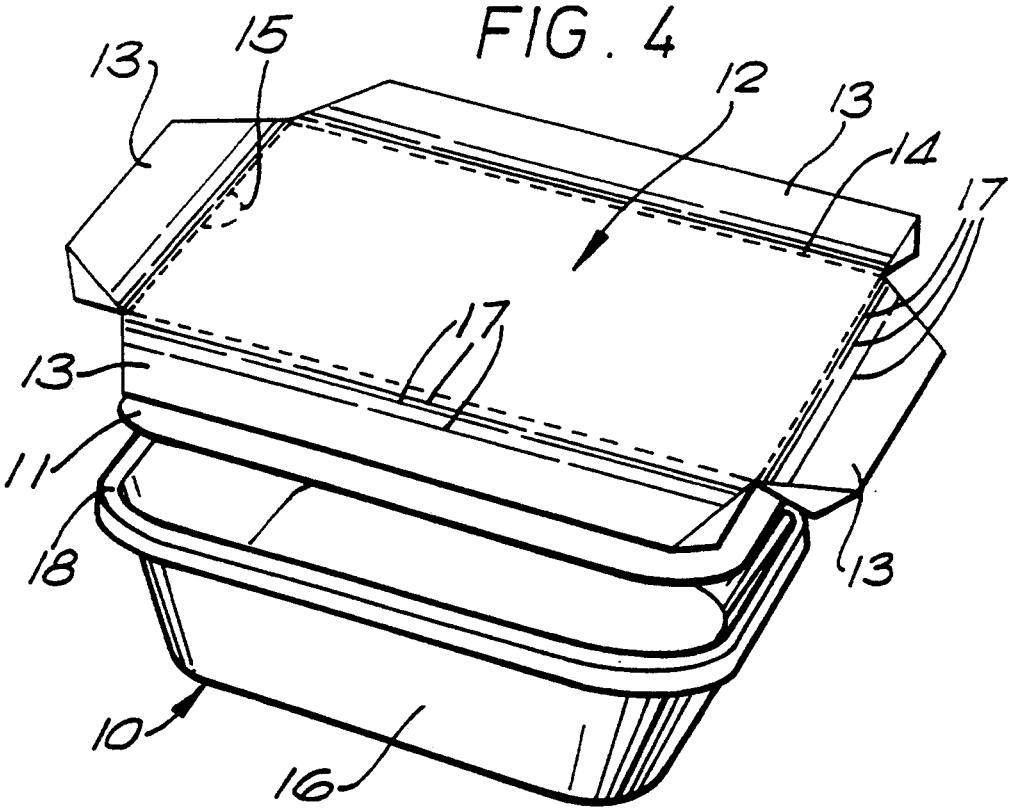
FIG. 4 is an exploded perspective view of a package according to the first embodiment of the invention.

Referring to FIGS. 1 to 4 of the drawings, which illustrate a first embodiment of the present invention, the package comprises a high temperature resistant CPET tray 10 having a peelable film lid 11, the tray being defined by a base, and a sidewall which extends from the base to a top edge which defines a tray opening. The package is provided with an aluminum laminate tray-top cover 12 with depending side edge portions 13 and with precut lines of weakening 14, 15 to enable the top central portion of the cover to be removed by tearing off. The cover is formed from a blank, as illustrated in FIG. 3, in which fold lines 17 are provided to conform the blank after folding to the shape of the tray. The depending cover side edge portions 13 are glued or sealed to the tray side wall 16.

The top of the laminate cover 12 may be sealed together with the lid 11 and tray side wall top edge flange 18 (FIG. 4) of the package.

Figure 5:
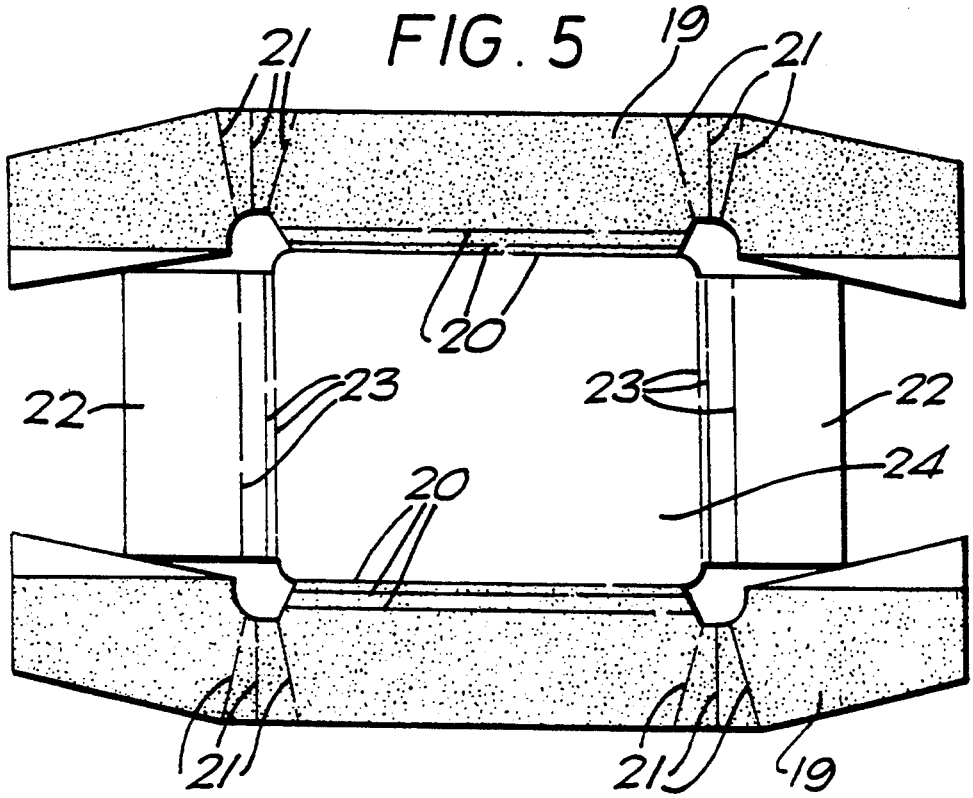
FIG. 5 is a plan view of a blank for preparing a cover according to the invention.

FIG. 5 illustrates a blank for an alternative cover having two side edge portions 19 of aluminum laminate containing fold lines 20 and 21 and having two side edge portions 22 without aluminum foil containing fold lines 23 to conform the blank after folding to the shape of a tray. The central portion 24 of the blank adjacent fold lines 20 and 23 is a cardboard laminate without aluminum foil. After folding, edge portions 19 and 22 will be glued or sealed to a tray side wall, such as tray side wall 16 of FIG. 4.

Figure 6:
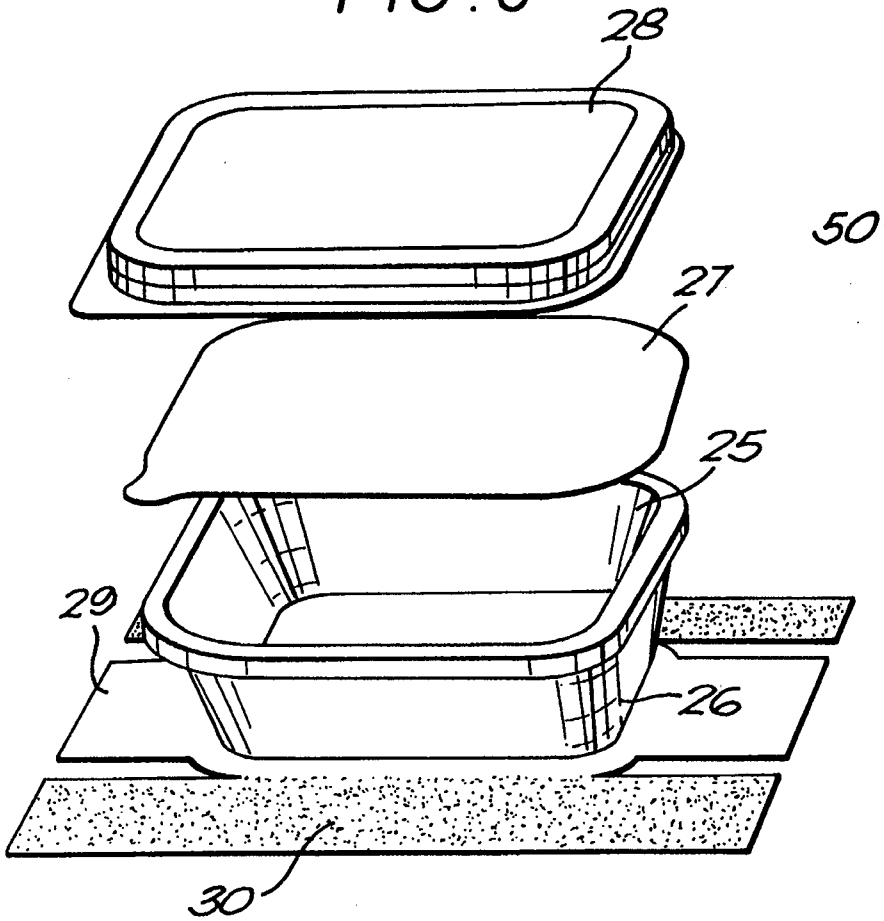
FIG. 6 is an exploded perspective view of a package including a base cover blank according to the second embodiment of the invention.

FIG. 6 shows a package comprising a high temperature resistant CPET tray 25 having side wall 26, a peelable lid 27 and a plastic over-cover 28. A cardboard cover blank 29, having side edge portions 30 laminated by a coating of aluminum foil, is provided for being wrapped around the base and side wall of the tray so that the aluminum laminate side edge portions 30 form a shield around the total part of the tray side wall.

FIG. 7 illustrates a further partially laminated cardboard shield blank design which has two side edge portions 29 without aluminum foil and two side edge portions 30 of aluminum laminate. Fold lines 31, 32, 33 and 34 provide for folding the blank. The central cover portion 35 is a cardboard laminate without aluminum foil.

FIG. 8 shows a blank 36 made of ovenable cardboard material scored with fold lines so that when folded, a base is formed from blank central portion 37 and a side wall is formed from blank side edge portions 38, 39, 40, 41, which are provided with rims 42, 43, 44, 45, respectively, to seal a cardboard cover (not shown). Corner flaps 46, 47, 48, 49 are provided with fold lines to ensure that when the blank has been folded, the side walls are held together.

The blank side edge portions 40, 41 and the corner flaps 46, 47, 48 and 49 are coated with aluminum foil as shown by the shading. The advantage of this embodiment is that the product may be packed in the carton directly without the necessity of any overpackage.

Figure 9:
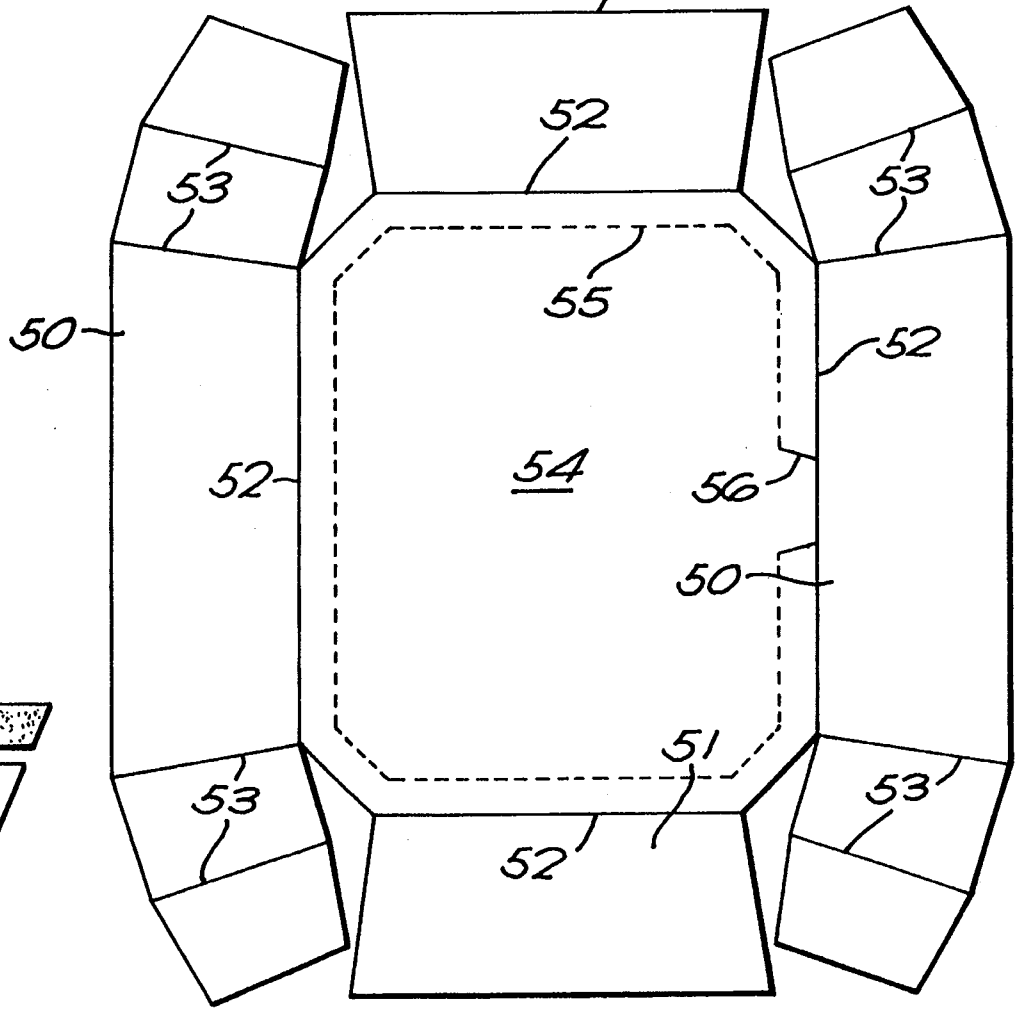
FIG. 9 is a plan view of a laminated aluminum/cardboard blank according to the invention.

FIG. 9 illustrates the design of a cardboard shield blank completely laminated with aluminum. The shield has four edge portions 50 and 51 of cardboard-/aluminum aluminum laminate. Fold lines 52 and 53 provide for folding the blank. The central portion 54 is a card-board/aluminum laminate provided with precut lines 55 and a tab 56 in order to facilitate the removal of the central portion.

I claim:

1. A package comprising a tray having a base and a side wall which extends from the base to a top edge, which define tray outer surfaces and tray interior surfaces which extend to define a tray opening, and comprising a cover which has a central portion made of a microwave transparent material positioned over the tray opening and which has aluminum laminated side edge portions which depend from the central portion and are secured to and cover the tray side wall outer surface.

2. A package comprising a tray having a base and a side wall which extends from the base to a top edge, which define tray outer surfaces and tray interior surfaces which extend to define a tray opening, and comprising a cover which has a central portion made of a microwave transparent material positioned over the tray base outer surface and which has aluminum laminated side edge portions which depend from the central portion and are secured to and cover the tray side wall outer surface.

3. A package according to claim 1 or 2 wherein the side edge portions are secured to the tray side wall outer surface by an adhesive.

4. A package according to claim 1 or 2 wherein the side edge portions are secured to the tray side wall outer surface by mechanical locking.

5. A package according to claim 1 further comprising a lid positioned between the cover and the tray top edge for covering the tray opening.

6. A package according to claim 1 or 2 wherein the microwave transparent material is a material selected from the group consisting of plastic, cardboard and paperboard materials suitable for heating food.

7. A package according to claim 1 or 2 wherein the tray is formed of a material selected from the group consisting of plastic, cardboard and paperboard materials suitable for heating food.

8. A package comprising a tray having a base and a side wall which extends from the base to a top edge, which define tray outer surfaces and tray interior surfaces which extend to define a tray opening, and comprising an aluminum laminate cover which has a central portion positioned over the tray opening, which has side edge portions which depend from the central portion and cover the tray side wall outer surface and which has lines of weakening positioned for tearing and removing the central cover portion from the cover.

9. A package comprising a tray having a base and a side wall which extends from the base to a top edge, which define tray outer surfaces and tray interior surfaces which extend to define a tray opening, and comprising an aluminum laminate cover which has a central portion positioned over the tray base outer surface, which has side edge portions which depend from the central portion and cover the tray side wall outer surfaces and which has lines of weakening positioned for tearing and removing the central portion from the cover.

10. A package according to claim 8 or 9 wherein the side edge portions are secured to the tray side wall outer surface by an adhesive.

11. A package according to claim 8 or 9 wherein the side edge portions are secured to the tray side wall outer surface by mechanical locking.

12. A package according to claim 8 further comprising a lid for covering the tray opening positioned between the cover and the tray top edge.

13. A package to claim 8 or 9 wherein the cover is comprised of aluminum foil laminated on a material selected from the group consisting of plastic, cardboard and paperboard materials suitable for heating food.

14. A package according to claim 8 or 9 wherein the tray is made of a material selected from the group consisting of plastic, cardboard and paperboard materials suitable for heating food.

* * * * *